US005634637A

United States Patent [19]

Tanaka

[11] Patent Number: 5,634,637

[45] Date of Patent: Jun. 3, 1997

[54] SHEET FEEDING APPARATUS

[75] Inventor: Makoto Tanaka, Nagaokakyo, Japan

[73] Assignee: Murata Kikai Kabushiki Kaisha, Kyoto, Japan

[21] Appl. No.: 450,411

[22] Filed: May 25, 1995

[30] Foreign Application Priority Data

Jun. 1, 1994 [JP] Japan ..... 6-119991

[51] Int. Cl.[6] ..... B65H 5/00

[52] U.S. Cl. ..... 271/275; 271/272; 271/186; 271/314

[58] Field of Search ..... 271/4.1, 10.11, 271/10.13, 225, 272, 273, 275, 184, 185, 186, 314

[56] References Cited

U.S. PATENT DOCUMENTS

| | | | |
|---|---|---|---|
| 4,056,263 | 11/1977 | LaWhite et al. | 271/275 |
| 4,268,021 | 5/1981 | Rutishauser et al. | 271/4.1 |
| 4,659,073 | 4/1987 | Leonard | 271/275 |
| 4,699,365 | 10/1987 | Smith et al. | 271/186 |
| 4,714,241 | 12/1987 | Randall | 271/186 |
| 4,986,525 | 1/1991 | Takagi et al. | 271/4.1 |

FOREIGN PATENT DOCUMENTS

| | | | |
|---|---|---|---|
| 1052728 | 3/1959 | Germany | 271/186 |

*Primary Examiner*—H. Grant Skaggs
*Attorney, Agent, or Firm*—Loeb & Loeb LLP

[57] ABSTRACT

A sheet feeding arrangement has a main body and a width direction. A sheet passage extends in a main body of the arrangement like a letter "U" in a direction perpendicular to the width direction of the arrangement. The "U" of the passage has a predetermined width in the width direction of the arrangement. A sheet feeding shaft is supported inside the "U" of the sheet passage and extends in the width direction of the arrangement. The sheet feeding shaft has a drive roller fixedly mounted thereon. The drive roller partly extends into the sheet passage to be able to contact a sheet in the sheet passage. A motor is connected with the sheet feeding shaft for driving the shaft to feed the sheet by the drive roller. A speed reduction mechanism is provided between the motor and the sheet feeding shaft to transmit drive power from the motor to the shaft with a reduced speed. The sheet feeding shaft and the speed reduction mechanism are united with the motor to form a sheet feeding unit, and the sheet feeding unit is confined inside the "U" of the sheet passage. The sheet feeding unit can be designed to be compact in the width direction of the sheet feeding arrangement so that an overall dimension of the sheet feeding arrangement can also be reduced.

3 Claims, 7 Drawing Sheets

SHEET FEEDING APPARATUS

BACKGROUND OF THE INVENTION

1. Technical Field

The present invention relates to a sheet feeding apparatus which includes a sheet feed shaft having a drive roller wherein the shaft is driven by a motor to move a sheet through a U-shaped sheet passage.

2. Background Art

Various sheet feeding apparatuses of the above-mentioned type are known in the art, and one of them is schematically illustrated FIGS. 7 and 8 of the accompanying drawings.

Referring to FIG. 7, a conventional sheet feeding apparatus 100 includes a plurality of parallel sheet feeding shafts 111, 112 and 113, a single drive motor 120 located on one side of these shafts (on the left side in the illustration) for these shafts 111–113 and a speed reduction mechanism 130. The speed reduction mechanism 130 is supported between a drive shaft 121 extending outwardly from the drive motor 120 and free ends (leftmost ends in the illustration) of the shafts 111–113. The speed reduction mechanism 130 includes a plurality of gears 131, 132 and 133 mounted on the shafts 111–113 on the free ends thereof, respectively. Upon driving the drive motor 120, the drive shaft 121 is rotated and in turn the sheet feed shafts 111–113 are rotated via the speed reduction mechanism 130. As a result, drive rollers 141, 142 and 143 fixedly mounted on the shafts 111–113 rotate so that a sheet K (FIG. 8) is fed into a U-shaped sheet passage 140 toward a discharge end of the sheet passage.

In this conventional sheet feeding apparatus, however, the drive shaft 121 and the speed reduction mechanism 130 (or the three gears 131–133) are positioned outward of the shafts 111–113 in their axial directions as indicated by the double-arrow. Therefore, a space is required next to the shafts 111–113 for these elements. This enlarges the width of the apparatus. Accordingly, the width of the apparatus becomes much greater than the width of the sheet K.

SUMMARY OF THE INVENTION

An object of the present invention is to provide a sheet feeding apparatus which is compact and can save the space.

According to one aspect of the present invention, there is provided a sheet feeding apparatus of a type having a U-shaped sheet passage in a main body of the apparatus, a sheet feeding shaft rotatably supported inside the "U" of the sheet passage, the shaft extending in a direction perpendicular to a plane defined by the letter "U" of the passage or a with direction of the apparatus, a drive roller mounted on the sheet feeding shaft and partly extending into the sheet passage to contact a sheet in the sheet passage and a motor for driving the shaft and in turn the drive roller to feed the sheet, characterized in that a speed reduction mechanism for transmitting drive power of the motor to the shaft with a reduced speed and the sheet feeding shaft with the drive roller are united with the isolator (this assembly is referred to as "sheet feeding unit") and the sheet feeding unit is placed inside the "U" of the sheet passage. As the motor is activated, the drive roller is driven via the speed reduction mechanism to move the sheet in the passage. Since the speed reduction mechanism and the sheet feeding shaft having the drive roller are united with the motor to constitute a compact sheet feeding unit and the sheet feeding unit is confined in the "U" of the sheet passage, the sheet feeding unit does not extend over the width of the sheet. Therefore, a compact sheet feeding apparatus can be designed.

The sheet feeding unit may include a single motor, a plurality of sheet feeding shafts having drive rollers respectively, each roller having a diameter smaller than a diameter of the motor, and a speed reduction mechanism for transmitting drive power to the sheet feeding shafts from the motor. As the motor is driven, the drive power is transmitted to the sheet feeding shaft by way of the speed reduction mechanism. Accordingly, the shaft or drive roller rotates and the sheet is moved through the sheet passage. In this case also, the sheet feeding unit does not extend over the width of the sheet so that a compact sheet feeding apparatus can be designed.

The sheet feeding unit may include a single sheet feeding shaft with a drive shaft, a motor whose diameter is smaller than that of the drive roller and a speed reduction mechanism having a width smaller than that of the drive roller. In this case, the number of parts required is reduced and the overall structure of the sheet feeding apparatus is simplified.

DETAILED DESCRIPTION OF THE PREFERRED EMBODIMENTS

Now, preferred embodiments of a sheet feeding apparatus according to the present invention will be described with reference to FIGS. 1 to 6 of the accompanying drawings.

The following description deals with a sheet feeding apparatus which is incorporated in a facsimile machine.

Figure 1:
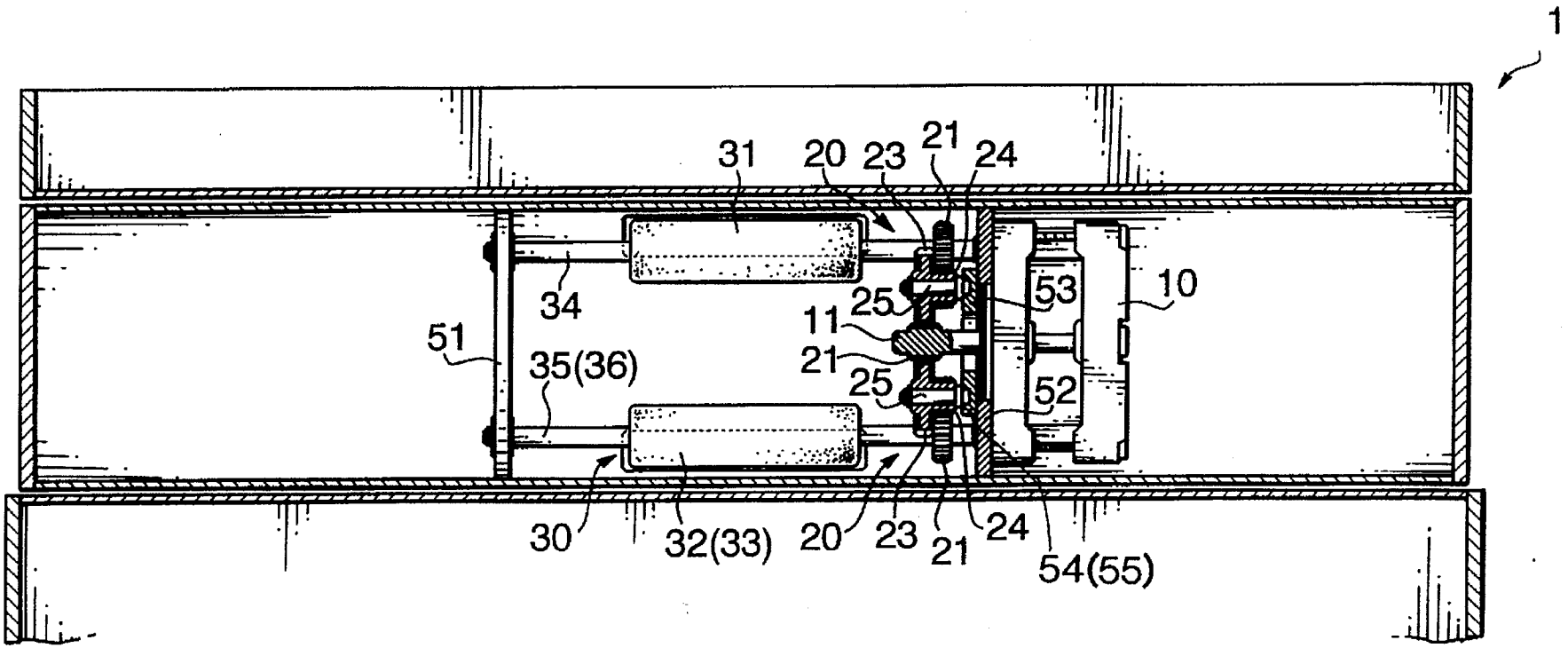
FIG. 1 is a front vertical section of a sheet feed apparatus according to a first embodiment of the present invention, showing internal structure of the apparatus.
Figure 2:
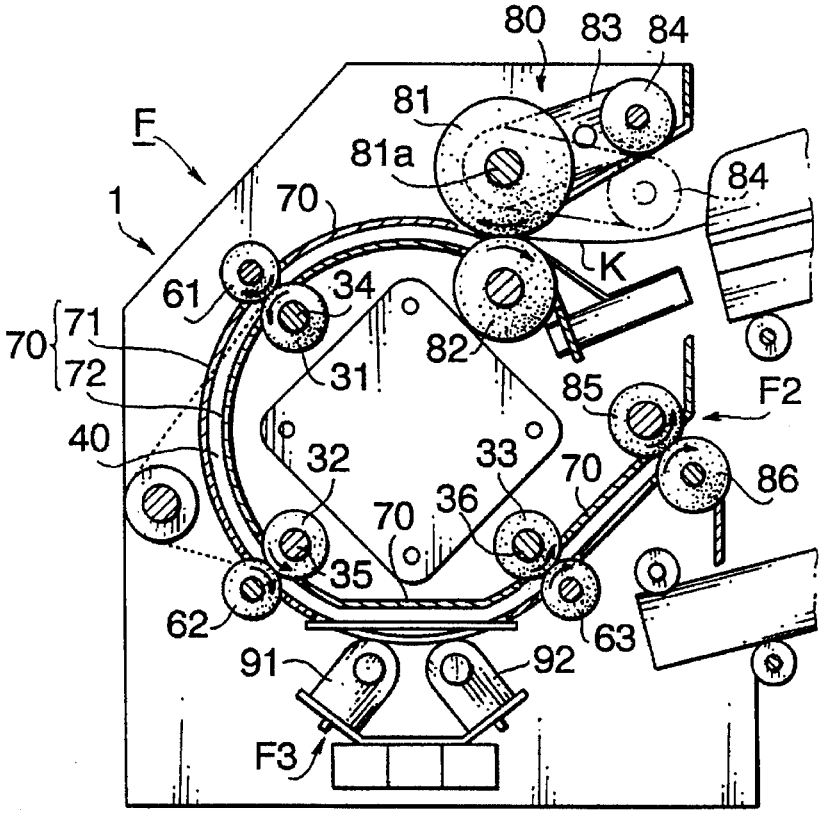
FIG. 2 illustrates a lateral section of the sheet feed apparatus shown in FIG. 1.
Figure 5:
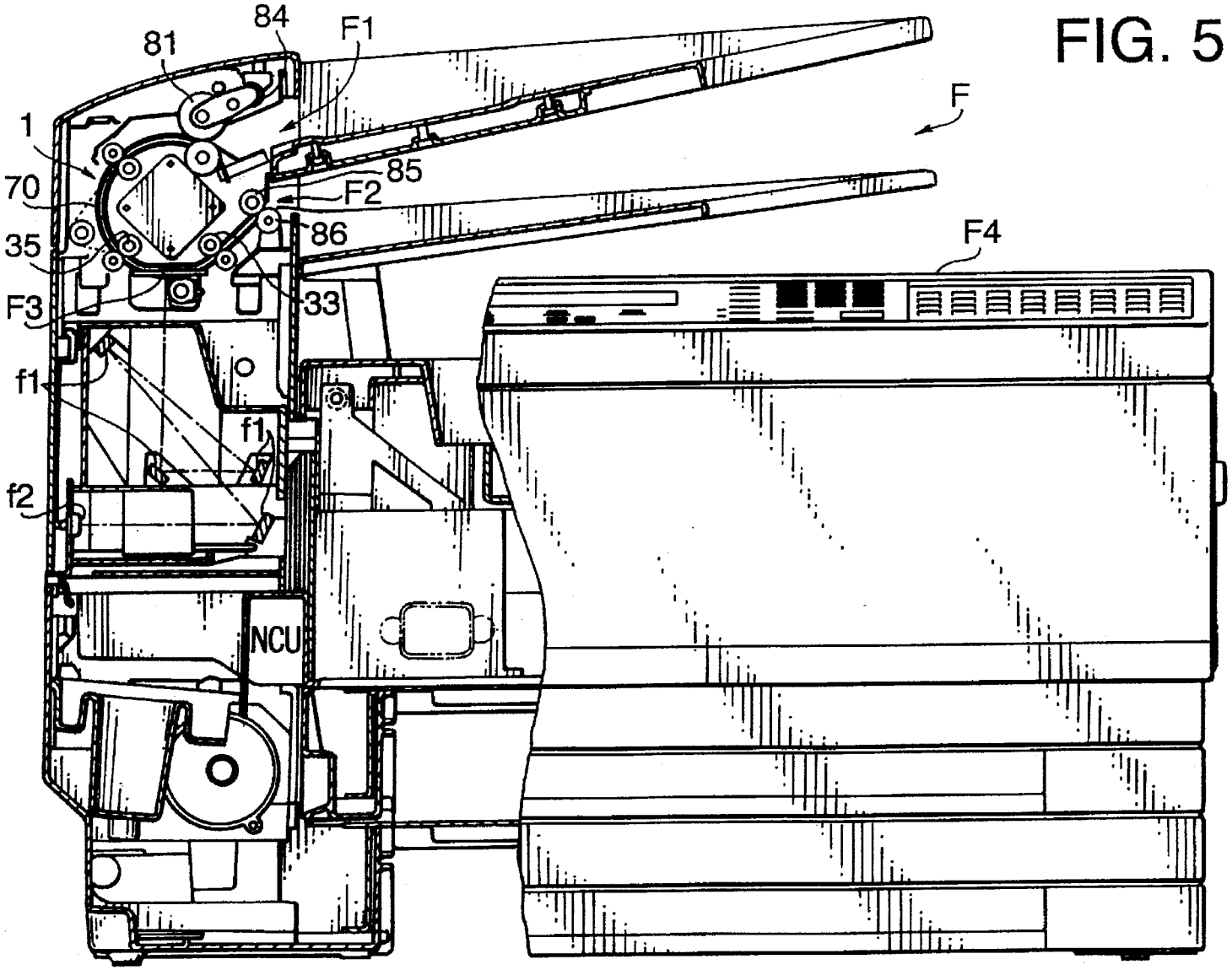
FIG. 5 is a partially sectional front view of a facsimile machine which incorporates the sheet feeding apparatus of the first embodiment.

Referring to FIGS. 1, 2 and 5, a sheet feeding apparatus according to a first embodiment will be explained.

The sheet feeding apparatus 1 is placed in the facsimile machine F as shown in FIG. 5. Sheets on an upper tray are fed into the sheet feeding apparatus 1 and discharged onto a lower tray. As illustrated in FIG. 1, a speed reduction mechanism 20 which includes a plurality of gears is mounted on a shaft 11 of a motor 10, and three sheet feeding shafts 34, 35 and 36 having drive rollers 31, 32 and 33 respectively are cooperatively connected with outermost gears 21, 21 and 21, each having a small diameter, of the speed mechanism 20 to constitute a sheet feeding unit 30. Referring to FIG. 2, the sheet feeding unit 30 is located inside a "U" of the U-turned sheet passage 40. The sheet feeding unit 30 extends in a direction perpendicular to a plane defined by the "U" of the sheet passage 40.

Referring back to FIG. 1, the three sheet feeding shafts 34–36 are rotatably supported by left and right support walls 51 and 52 standing In the sheet passage 40. The drive rollers 31–33 are fixedly mounted on the respective shafts 34–36 at the center of the shaft.

The motor 10 is mounted on an outer face of the right support wall 52 (but does not protrude from the sheet passage 40), and a drive shaft 11 of the motor 10 rotatably penetrates the right support wall 52 thereby projecting toward the drive rollers 31–33. A small diameter drive gear 21 is fixedly mounted on the motor drive shaft 11 at its free end. A speed reduction gear unit 25 having large diameter gears 23 and small diameter gears 24 is rotatably supported by three gear supports 53, 54 and 55 mounted on an inner face of the right support wall 52. The large diameter gears 23 engage with the drive gear 21 of the drive shaft.

The outermost small diameter gears 21 of the speed reduction mechanism 20 mesh with the signal diameter gears 24 of the speed reduction gear unit 25.

Therefore, as the motor 10 is driven and the drive shaft 11 is rotated, rotation of the drive gear 21 is transmitted to the large gear 23 of the speed reduction gear assembly 25 so that the gear assembly 25 is rotated at a slower speed. At the same time, rotation of the small gears 24 of the gear assembly 25 is transferred to the small gears 21 of the sheet feeding shafts 34–36 so that these shafts 34–36 are rotated at a reduced speed. Accordingly, the drive rollers 31–33 mounted on the shafts 34–36 rotate to feed a sheet K into the sheet passage 40 from a sheet passage entrance F1 of the facsimile machine F toward a sheet passage exit F2 (FIG. 2).

The drive rollers 31, 32 and 33 have trailing rollers 61, 62 and 63 respectively which abut and are rotated by the associated drive rollers. Rotation of the drive rollers 31–33 and that of the trailing rollers 61–63 feed the sheet K through the sheet passage 40.

The sheet passage 40 generally has a U shape and is defined by a plurality of sheet guides 70. Each sheet guide 70 has a pair of inner and outer arcuate guide plates 71 and 72 spaced with predetermined clearance for passage of the sheet K. Each sheet guide 70 extends between one pair of drive and trailing rollers and a next pair.

Provided at the sheet entrance F1 of the facsimile machine F is a draw-in or take-in roller assembly 80.

The draw-in roller assembly 80 includes a large diameter feed roller 81, a separation roller 82 which rotates in a direction opposite the large feed roller 81 to allow only one sheet K to proceed through the rollers 81 and 82, and a pick-up roller 84 rotatably supported on a free end of a support plate 83. The support plate 83 is pivotable about an axis 81*a* of the large feed roller 81 and movable in a generally vertical direction in this particular application.

When the support plate 83 is in a lowered position as indicated by the phantom line in FIG. 2, the pick-up roller 84 feeds the sheets K toward the passage entrance F1 from the feed tray and the large feed roller 81 causes the sheet K to advance in the passage 40.

At the passage exit F2 of the facsimile machine F, provided is a discharge roller 85 and its trailing roller 86. The trailing roller 86 contacts the roller 85 and is driven by the roller 85. The sheet K which has traveled through the sheet passage 40 is discharged upon rotation by the discharge roller 85.

At the lowermost portion of the U-shaped passage 40 in FIG. 2, provided is a document reader unit F3 having an LED 91 and a CCD 92. Image data on the sheet K is read by the image reader unit F3 as it proceeds in the passage 40.

Now, operations of the sheet feeding apparatus 1 will be described.

As the sheets K are piled up on the feed tray near the passage entrance F1 and a start key (not shown) is turned on, the motor 10 is driven and a drive motor for the pick-up roller 80 (not shown) as well as a drive motor for the discharge roller 85 (not shown) are driven.

Then, the support plate 83 of the roller assembly 80 is moved downward and at least one sheet K is picked up from the sheet pile by rotation of the draw-in roller 84. When the sheet(s) reaches the rollers 81 and 82, rotation of the feed roller 81 in the feeding direction and rotation of the separation roller 82 in the opposite direction allow only one sheet to go therethrough. Therefore, the sheets are fed into the passage 40 one sheet by one sheet from the sheet pile. The sheet K is carried into the passage 40 by rotation power of the large feed roller 81.

In the passage 40, the sheet K is fed toward the passage end F2 upon rotation of the drive rollers 31, 32 and 33. On its way to the passage end F2, the sheet K is read by the image reader unit F3. When the speed K reaches the passage end F2, it is discharged out of the apparatus by the discharge roller 85.

After picking up one sheet K and directing it to the passage entrance F1, the pick-up roller 80 is moved upward together with the support plate 83 to a raised position as indicated by the solid line in FIG. 2. When the sheet K just picked up completely enters the sheet passage 40, the support plate 83 and the roller 80 are again lowered to pick up another sheet K.

Since the sheet feeding unit 30 which includes the motor 10, the speed reduction mechanism 20 and the three sheet feeding shafts 34–36 having the drive rollers 31–33 is placed inside the sheet passage 40, it does not extend over the sheet K in the width direction. This makes it possible to construct a compact sheet feeding apparatus.

Referring to FIG. 5, the facsimile machine F which incorporates the sheet feeding apparatus 1 is illustrated.

The sheet feeding apparatus 1 is placed over the reader unit F3 of the facsimile machine F. The document K fed from the document feeding area F1 is read by the reader unit F3 on its way to the document discharge area F2, as described above.

Under the reader module F3, provided are a plurality reflection plates f1 which reflect the image on the document K from the reader unit F3. The reflected image is then captured by an image reader/sensor f2 formed by a CCD or the like.

In FIG. 5, numeral F4 designates a laser printer type facsimile main body which uses cut sheets.

Figure 3:
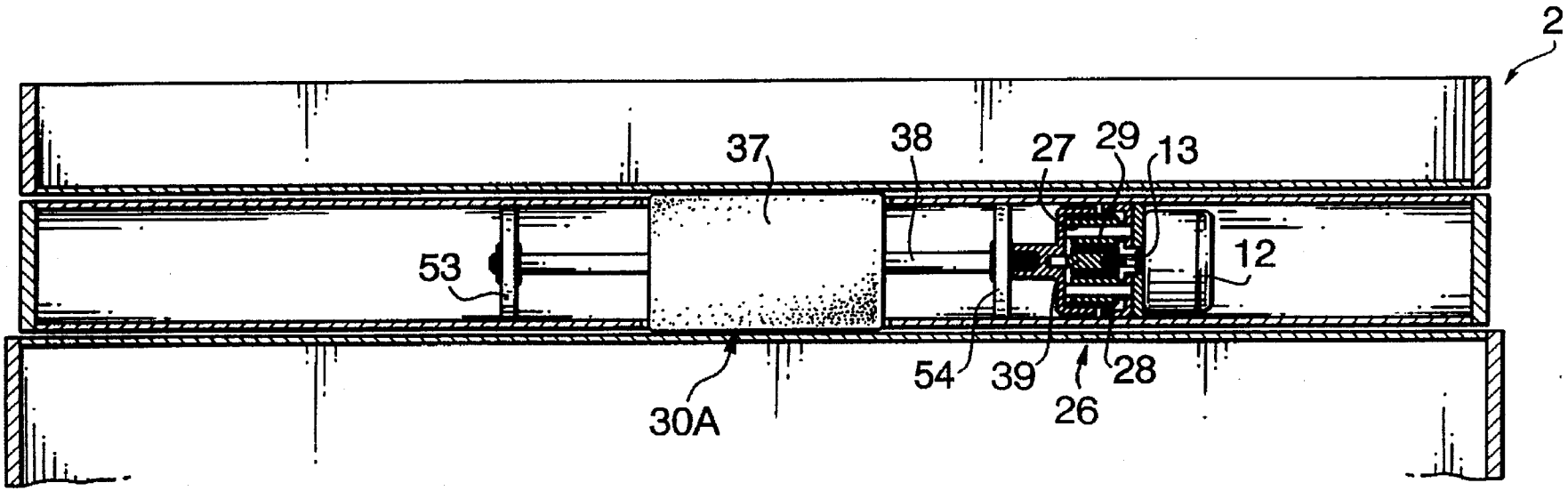
FIG. 3 is a front vertical section of a sheet feed apparatus according to a second embodiment of the present invention, showing internal structure of the apparatus.

A second embodiment of the present invention will be described with reference to FIGS. 3, 4 and 6.

A sheet feeding apparatus 2 of the second embodiment has a sheet feeding shaft 38, a large diameter drive roller mounted on the shaft 38 and having the same diameter as the passage 41, a motor 12 having a smaller diameter than the drive roller 37 and a speed reduction mechanism 26 for transmitting rotation of a drive shaft 13 of a motor 12 to the sheet feeding shaft 38 with a reduced speed and having a smaller width than the drive roller 37.

The sheet feeding shaft 38 is rotatably supported by left and right support walls 53 and 54 located in a sheet passage 41. The shaft 38 protrudes outwardly from the right wall 54

(to the right in FIG. 3) and rotatably supports two planetary gears 27 and 28 by its enlarged support portion 39. The planetary gears 27 and 28 and the drive gear 29 form the speed reduction mechanism 26.

The planetary gears 27 and 28 mesh with a drive gear 29 fixedly mounted on the drive shaft 13 of the motor 12 so that the rotation of the motor drive shaft 13 is slowed down and transmitted to the sheet feeding shaft 38 by the speed reduction mechanism 26 having the two planetary gears 27 axed 28 and the drive gear 29. Accordingly, the large diameter drive roller 37 fixed on the sheet feeding shaft 38 is rotated at a slower speed.

Figure 4:
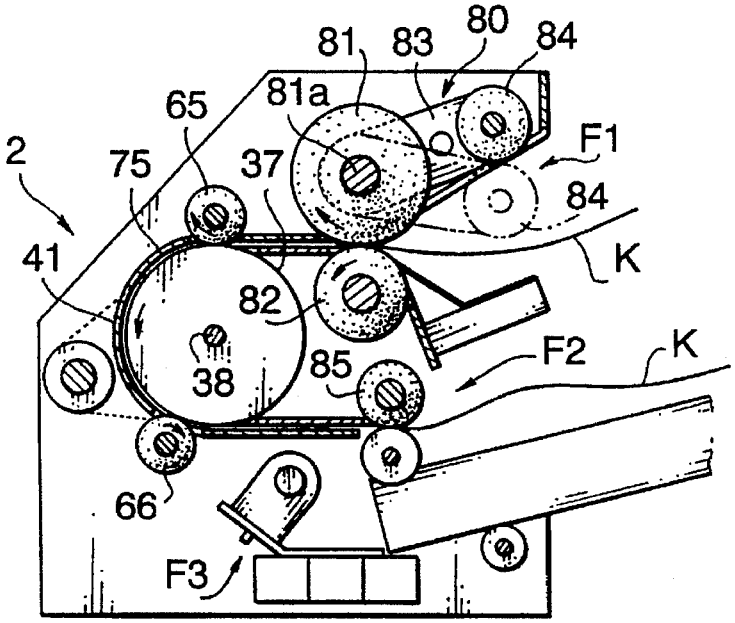
FIG. 4 is a lateral section of the sheet feed apparatus shown in FIG. 8.

At generally opposite positions on the outer periphery of the large diameter drive roller 37, provided are trailing rollers 65 and 66 as shown in FIG. 4. Extending between these trailing rollers 65 and 66 with a predetermined gap from the drive roller 37 is an arcuate guide plate 75 which forms part of the sheet passage 41.

In this sheet feeding apparatus 2, a sheet feeding unit 30A is formed by the single sheet feeding shaft 38 with the drive roller 37, the motor 12 having a smaller diameter than the drive roller 37 and the speed reduction mechanism 26 having a smaller width than the drive roller 37.

The sheet entrance F1, the draw-in roller 80 placed at the sheet passage entrance F1, the sheet exit F2 and the reader unit F3 are identical those illustrated in FIGS. 1 and 2 so that description of these elements is omitted here.

Now, operations of the sheet feeding apparatus 2 this embodiment will be described.

As the sheets K are set near the passage entrance and a start key (not shown) is pressed, the motor 12 is activated and simultaneously a drive motor for the pick-up roller assembly 80 (not shown) and a drive motor for the discharge roller 85 (not shown) are activated.

Then, the support plate 83 having the take-in roller 80 at its free end is lowered as indicated by the phantom line, and the take-in roller 84 and the separation roller 82 rotating the opposite directions pick up one sheet K from the sheet pile and directs it to the passage entrance F1. At the passage entrance F1, the large feed roller 81 is rotating in the feeding direction so that the sheet K is forced into the sheet passage 41.

In the sheet passage 41, the sheet K is forwarded to the passage exit F2 along the arcuate guide plate 75 or the round outer surface of the drive roller 37 by rotation of the large drive roller 37. The drive roller 37 is rotated upon rotation of the sheet feeding shaft 38 driven by the motor 12. Image data on the sheet K is read by the reader module F3 on its way to the passage exit F2. When the sheet K reaches the passage exit F2, it is discharged from the sheet feeding apparatus 2 by the discharge roller 85.

In this embodiment, since the single sheet feeding shaft 38 with the drive roller 37, the motor 12 having a smaller diameter than the drive roller 37 and the speed reduction mechanism 26 having a smaller width than the drive roller 37 form the sheet feeding unit 30A and are confined in the sheet passage 41, the sheet feeding unit 30A does not extend over the width or the sheet K. Thus, a compact sheet feeding apparatus 2 can be designed.

In addition, the single sheet feeding shaft 38 and the large drive roller 37 mounted on the shaft are used to direct the sheet K toward the passage exit F2 in the passage 41 so that it is not necessary to provide a plurality of sheet feeding shafts and a plurality of associated drive rollers. This reduces the number of parts required and simplifies the structure of the sheet feeding apparatus.

Figure 6:
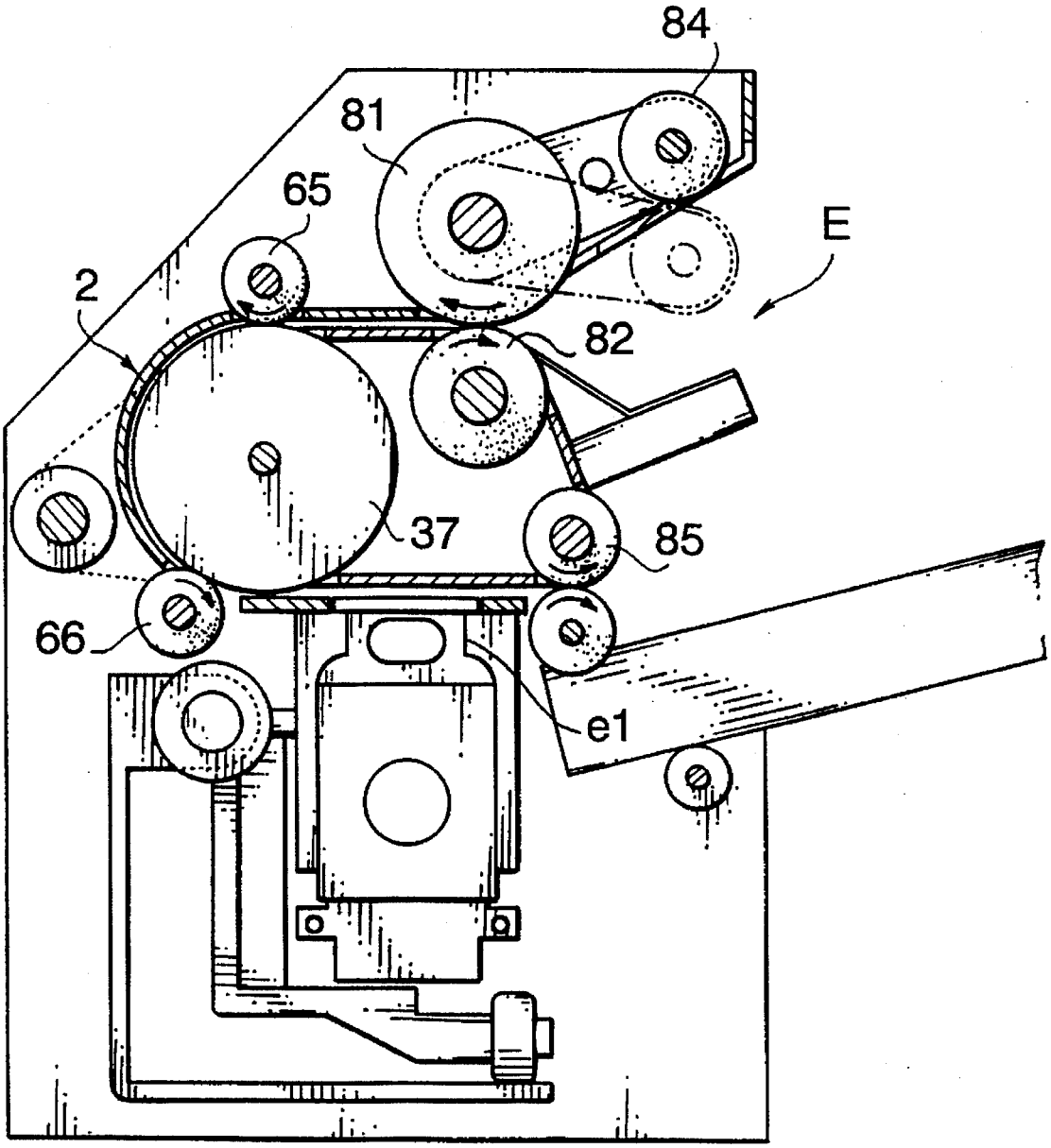
FIG. 6 illustrates a partially sectional printing machine which incorporates the sheet feeding apparatus of the second embodiment.
Figure 7:
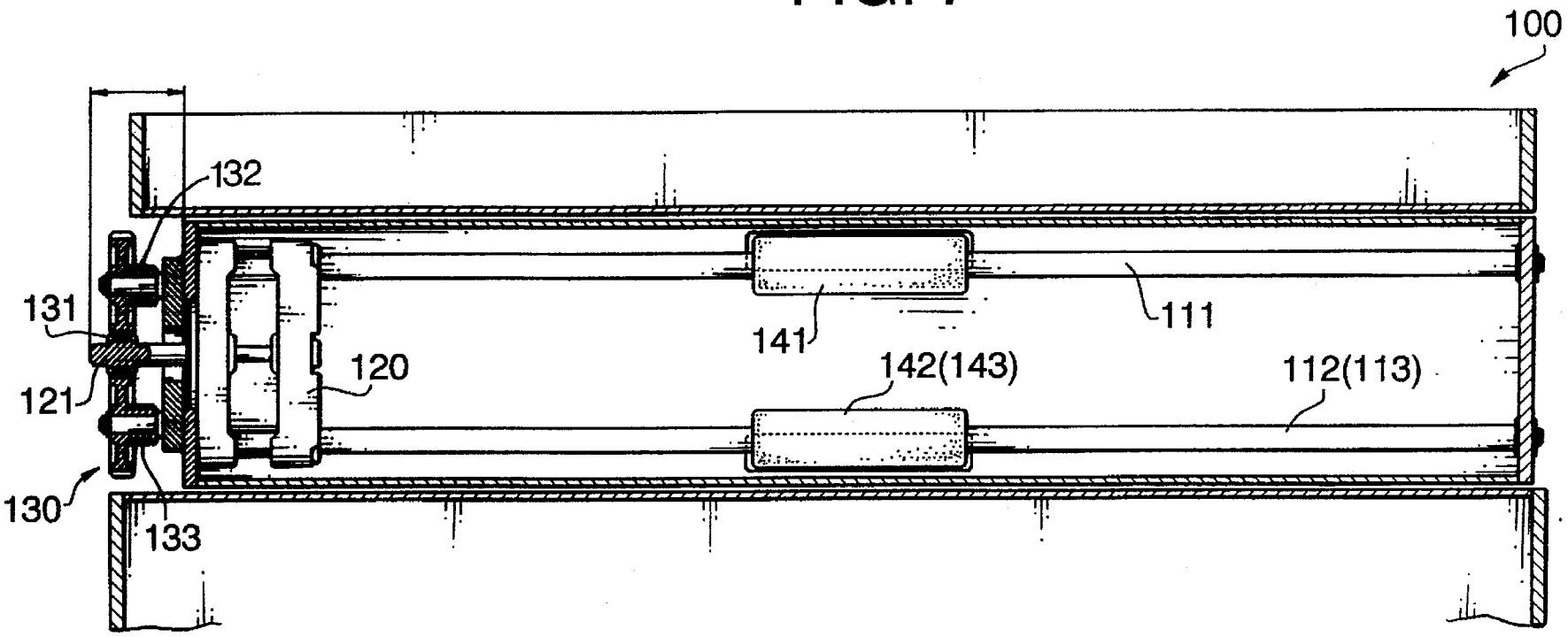
FIG. 7 illustrates a front vertical section of a conventional sheet feeding apparatus, showing its internal structure.
Figure 8:
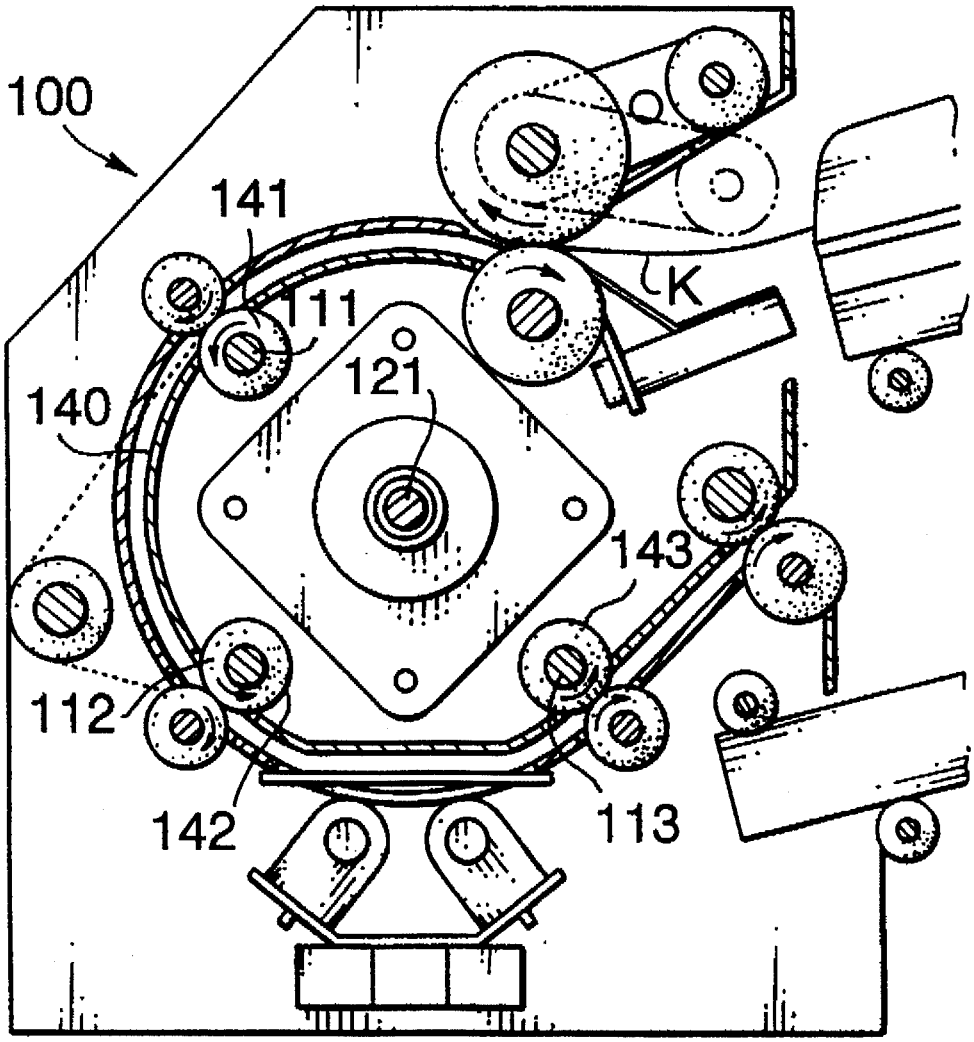
FIG. 8 shows a lateral section of the conventional sheet feeding apparatus.

Referring to FIG. 6, a major portion of a printing machine E which incorporates the sheet feeding apparatus 2 is shown.

A sheet (not shown) is fed from an entrance side into the sheet passage and printing is carried out on the sheet by an ink jet printhead e1 located in the printing machine E. The printhead e1 is placed below the sheet feeding apparatus 2 so that an ink jet is applied onto the sheet when the sheet lies horizontally.

What is claimed is:

1. A sheet feeding apparatus having a main body, a width direction, and a substantially U-shaped sheet passage extending in the main body in a direction perpendicular to the width direction, the substantially U-shaped portion of the sheet passage having a predetermined width in the width direction of the apparatus, the apparatus comprising:

a plurality of sheet feeding shafts placed inside the substantially U-shaped portion of the sheet passage, the plurality of shafts extending in the width direction of the apparatus, a plurality of drive rollers, the plurality of drive rollers corresponding in number to the plurality of sheet feeding shafts, each one of the plurality of rollers being fixedly mounted on a corresponding one of the plurality of shafts, at least one of the plurality of rollers partly extending into the sheet passage to be able to contact a sheet in the sheet passage, a motor connected with the plurality of shafts for driving the shafts to feed the sheet by the rollers, the motor defining a diameter, each of the plurality of drive rollers having a diameter smaller than the diameter of the motor, and a speed reduction mechanism provided between the motor and at least one of the plurality of shafts for transmitting drive power from the motor to the plurality of shafts with a reduced speed, the shafts and the speed reduction mechanism being united with the motor to form a sheet feeding unit, the sheet feeding unit being placed inside the substantially U-shaped portion of the sheet passage.

2. A sheet feeding apparatus having a main body, a width direction, and a substantially U-shaped sheet passage extending in the main body in a direction perpendicular to the width direction, the substantially U-shaped portion of the sheet passage having a predetermined width in the width direction of the apparatus, the apparatus comprising:

a sheet feeding shaft placed inside the substantially U-shaped portion of the sheet passage, the shaft extending in the width direction of the apparatus, a drive roller fixedly mounted on the shaft, the roller partly extending into the sheet passage to be able to contact a sheet in the sheet passage, the drive roller defining a width, a motor connected with the shaft for driving the shaft to feed the sheet by the roller, the motor defining a diameter, the drive roller having a diameter that is larger than the diameter of the motor, and a speed reduction mechanism provided between the motor and the shaft for transmitting drive power from the motor to the shaft with a reduced speed, the speed reduction mechanism having a width that is smaller than the width of the drive roller, the shaft and the speed reduction mechanism being united with the motor to form a sheet feeding unit, the sheet feeding unit being placed inside the substantially U-shaped portion of the sheet passage.

3. The sheet feeding apparatus of claim 1 or 2, wherein the sheet passage is defined by an inner arcuate guide plate having a substantially U-shaped portion and an outer arcuate guide plate having a substantially U-shaped portion, the inner guide plate and the outer guide plate being spaced apart by a predetermined distance, and wherein the sheet feeding unit is positioned inside the substantially U-shaped portion of the inner arcuate guide plate.

* * * * *